US010907591B2

(12) United States Patent
Golladay et al.

(10) Patent No.: US 10,907,591 B2
(45) Date of Patent: Feb. 2, 2021

(54) INTERNAL COMBUSTION ENGINE AND METHOD FOR DETECTING A LEAK FROM A CRANKCASE AND/OR A TANK VENTILATION SYSTEM

(71) Applicant: Bayerische Motoren Werke Aktiengesellschaft, Munich (DE)

(72) Inventors: Jessica Golladay, Munich (DE); Markus Haslbeck, Freising (DE); Robert Biebl, Hunding (DE); Stephan Renner, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 396 days.

(21) Appl. No.: 15/729,740

(22) Filed: Oct. 11, 2017

(65) Prior Publication Data

US 2018/0030937 A1 Feb. 1, 2018

Related U.S. Application Data

(63) Continuation of application No. PCT/EP2016/063587, filed on Jun. 14, 2016.

(30) Foreign Application Priority Data

Jul. 24, 2015 (DE) ..... 10 2015 213 982

(51) Int. Cl.
*F02M 35/10* (2006.01)
*F01M 13/02* (2006.01)
(Continued)

(52) U.S. Cl.
CPC ..... *F02M 35/1038* (2013.01); *F01M 13/022* (2013.01); *F01M 13/023* (2013.01);
(Continued)

(58) Field of Classification Search
CPC ..... F02M 25/0836; F02M 35/1038; F02M 25/0827; F02M 25/089; F01M 13/022;
(Continued)

(56) References Cited

U.S. PATENT DOCUMENTS 6,098,603 A 8/2000 Maegawa et al.
9,322,367 B2 * 4/2016 Vigild ..... F02M 25/0836
(Continued)

FOREIGN PATENT DOCUMENTS

DE 10 2009 008 831 A1 8/2010
DE 10 2011 054 851 A1 5/2013
(Continued)

OTHER PUBLICATIONS

International Search Report (PCT/ISA/210) issued in PCT Application No. PCT/EP2016/063587 dated Nov. 7, 2016 with English translation (Five (5) pages).
(Continued)

*Primary Examiner* — Mahmoud Gimie
*Assistant Examiner* — Joshua Campbell
(74) *Attorney, Agent, or Firm* — Crowell & Moring LLP

(57) ABSTRACT

An internal combustion engine has a tank ventilation system and a crankcase ventilation system. The tank ventilation system is connectable to an intake system downstream of a throttle element via a first non-return valve in a first line and upstream of a compressor via a second non-return valve in a second line and a third non-return valve in a second sub-line. The crankcase ventilation system is connectable to the intake system downstream of the throttle element via a fourth non-return valve in a third line and upstream of the compressor via a fourth line and the third non-return valve. The intake system is connectable to the second line downstream of the throttle element at a transitional point between the second line and the second sub-line via a fifth nonreturn
(Continued)

valve in a fifth line. A nozzle is formed at the transitional point from the fifth line to the second line and the second sub-line, and the second line opens into the nozzle downstream of the second non-return valve. A first pressure sensor for measuring the pressure in the second line is provided in the second line between the second non-return valve and the nozzle. Only a single pressure sensor is required to diagnose or detect a leak.

11 Claims, 4 Drawing Sheets

(51) Int. Cl.
*F02M 25/08* (2006.01)
*F01M 13/04* (2006.01)
*F01M 13/00* (2006.01)

(52) U.S. Cl.
CPC ..... *F01M 13/028* (2013.01); *F01M 13/04* (2013.01); *F02M 25/089* (2013.01); *F02M 25/0827* (2013.01); *F01M 2013/0044* (2013.01); *F01M 2013/026* (2013.01); *F01M 2013/027* (2013.01); *F01M 2250/60* (2013.01); *F02M 25/0836* (2013.01)

(58) Field of Classification Search
CPC ..... F01M 13/023; F01M 2013/0044; F01M 2013/026; F01M 2013/027
USPC ..... 123/572
See application file for complete search history.

(56) References Cited

U.S. PATENT DOCUMENTS

| | | | | |
|---|---|---|---|---|
| 2001/0022175 | A1 | 9/2001 | Moren | |
| 2011/0030659 | A1 | 2/2011 | Ulrey et al. | |
| 2013/0074589 | A1* | 3/2013 | Pursifull | F02M 25/0836 73/114.39 |
| 2013/0104857 | A1 | 5/2013 | Schulz | |
| 2014/0318514 | A1 | 10/2014 | Pursifull | |
| 2014/0345574 | A1* | 11/2014 | Haefele | F02M 25/0809 123/519 |
| 2015/0275826 | A1* | 10/2015 | Balsdon | F02M 25/0872 123/518 |
| 2015/0308310 | A1* | 10/2015 | Pursifull | F01M 13/022 123/403 |

FOREIGN PATENT DOCUMENTS

| | | |
|---|---|---|
| DE | 10 2014 105 235 A1 | 10/2014 |
| WO | WO 2013/053574 A2 | 4/2013 |

OTHER PUBLICATIONS

German-language Written Opinion (PCT/ISA/237) issued in PCT Application No. PCT/EP2016/063587 dated Nov. 7, 2016 (Seven (7) pages).

German-language Search Report issued in counterpart German Application No. 10 2015 213 982.4 dated Nov. 23, 2015 with partial English translation (Ten (10) pages).

* cited by examiner

| | Logic value |
|---|---|
| Sensor pressure = model pressure | 1 |
| Sensor pressure ≠ Model pressure | 0 |

| System state / pressure | Sensor pressure p1 | Sensor pressure p2 |
|---|---|---|
| No leak | 1 | 1 |
| Leak downstream of suction jet pump | 0 | 0 |
| Leak upstream of suction jet pump (on the tank venting side) | 0 | 1 |

Fig. 4

INTERNAL COMBUSTION ENGINE AND METHOD FOR DETECTING A LEAK FROM A CRANKCASE AND/OR A TANK VENTILATION SYSTEM

CROSS REFERENCE TO RELATED APPLICATIONS

This application is a continuation of PCT International Application No. PCT/EP2016/063587, filed Jun. 14, 2016, which claims priority under 35 U.S.C. § 119 from German Patent Application No. 10 2015 213 982.4, filed Jul. 24, 2015, the entire disclosures of which are herein expressly incorporated by reference.

BACKGROUND AND SUMMARY OF THE INVENTION

The invention relates to an internal combustion engine with a combustion air induction system, in which a compressor and a throttle element downstream thereof in the direction of flow of combustion air are disposed, and with a tank ventilation system and a crankcase ventilation system, wherein the tank ventilation system can be connected via a first non-return valve in a first line to the induction system downstream of the throttle element and can be connected via a second non-return valve in a second line and a third non-return valve in a second sub line to the induction system upstream of the compressor. The crankcase ventilation system can be connected via a fourth non-return valve in a third line to the induction system downstream of the throttle element and via a fourth line and the third non-return valve to the induction system upstream of the compressor. The invention also relates to a method for detecting a leak from a crankcase and/or a tank ventilation system of such an internal combustion engine.

For the technical background, reference is made, for example, to the German patent application DE 10 2009 008 831 A1, from which the present invention originates. From DE 10 2009 008 831 A1, an internal combustion engine is known with an induction air line that contains a compressor of an exhaust turbocharger and a throttle flap, and with a tank ventilation system and a crankcase ventilation system that are connected to the induction air line at two connection points upstream of the compressor and downstream of the throttle flap. In order to enable monitoring of the points of introduction of the ventilation gases in the induction air line in a relatively simple way, it is proposed that a respective or a common non-return valve is disposed directly at the connection points.

Because a defect of the tank ventilation system and/or of the crankcase ventilation system leads to the escape of unburnt hydrocarbons into the environment, in most states diagnostic methods have already been legally prescribed for a long time, with which the proper operation of the tank ventilation system and/or of the crankcase ventilation system can be diagnosed, so that a fault leading to an escape of unburnt hydrocarbons can be detected in a timely manner and can be remedied. Moreover however, for internal combustion engines with an exhaust turbocharger, the California Air Resource Board (CARB) also now requires additional monitoring of the points of introduction at which the tank ventilation gases and the crankcase ventilation gases are introduced into the induction air line. This should prevent undesirable harmful emissions of unburnt hydrocarbons from passing into the surroundings that are the result of loosening of the joints at the connection points or the result of a leak. Whereas the monitoring of the connection points of the tank ventilation line and/or the crankcase ventilation line, and the lines that open in the induction air line downstream of the throttle flap and that are used in induction mode to feed the ventilation gases into the induction air line, do not present problems, the connection point upstream of the compressor of the exhaust turbocharger of the tank and/or crankcase ventilation line or lines opening into the induction air line, through which the ventilation gases are introduced into the induction air line in the charging pressure mode, can only be monitored with difficulty depending on the sensor system and the design.

Based on said prior art, it is the object of the present invention to provide an internal combustion engine with which a leak of a crankcase ventilation system and/or of a tank ventilation system can be detected simply and inexpensively.

This object is achieved according to the invention by an internal combustion engine with a combustion air induction system, in which a compressor and a throttle element downstream thereof in the direction of flow of combustion air are disposed, and with a tank ventilation system and a crankcase ventilation system, wherein the tank ventilation system can be connected via a first non-return valve in a first line to the induction system downstream of the throttle element and can be connected via a second non-return valve in a second line and a third non-return valve in a second sub line to the induction system upstream of the compressor. The crankcase ventilation system can be connected via a fourth non-return valve in a third line to the induction system downstream of the throttle element and via a fourth line and the third non-return valve to the induction system upstream of the compressor. The induction system can be connected downstream of the throttle element via a fifth non-return valve in a fifth line to the second line at a line transition between the second line and the second sub line. A nozzle is implemented at the line transition from the fifth line in the second line and the second sub line, in which the second line opens downstream of the second non-return valve. A first pressure sensor for measuring the pressure in the second line is provided between the second non-return valve and the nozzle in the second line.

This object is also achieved by the method according to embodiments of the invention.

According to the invention, with the above design of the internal combustion engine it is thus possible to detect a leak in a crankcase ventilation system and/or a tank ventilation system with only a single sensor, i.e. a pressure sensor.

Thus, the requirements regarding harmful emissions, in particular hydrocarbon emissions (HG emissions), can be met without problems. Advantageously, as already shown, only a single pressure sensor is required for diagnosis/leak detection of the crankcase ventilation system and/or of the tank ventilation system.

In a further aspect of the invention, a second pressure sensor is provided in the second sub-line or the fourth line. With this design, it is possible to exactly define the leakage point as to whether the leak is located in the crankcase ventilation system or in the tank ventilation system.

A diagnostic device is preferably provided for the detection of a leak by evaluating the pressure of pressure sensors. In this case, the diagnostic device can also be an electronic control unit.

In another aspect of the invention, a tank ventilation valve is provided in the first line between a tank and the first and the second non-return valves. With this design, it is possible to turn the tank ventilation on or off depending on the requirement.

In yet another aspect of the invention, a second throttle element is provided between the fourth non-return valve and the fourth line. With this design, it is possible to set the mass flow of gas or the amount of gas flow, so that more accurate detection of a leak is enabled.

According to the invention, a method is provided for detecting a leak from the crankcase ventilation system and/or the tank ventilation system. The method includes the steps of: starting the internal combustion engine; measuring a first sensor pressure with the first pressure sensor; comparing the first sensor pressure with a first model pressure with the diagnostic device; evaluating whether the sensor pressure differs from the model pressure or not; in the event of no difference of the sensor pressure from the model pressure, no fault signal is output by the diagnostic device; and in the event of a difference of the sensor pressure from the model pressure, a fault signal is output by the diagnostic device. According to the method, it is possible to detect a leak in the crankcase ventilation system and/or the tank ventilation system simply and inexpensively.

In a further aspect of the inventive method, the method includes the steps of: measuring the first and second sensor pressures with the first pressure sensor and the second pressure sensor; comparing the first and second sensor pressures with a first and a second model pressure with the diagnostic device; evaluating whether a sensor pressure differs from the model pressure or not; and in the event of a difference of the first sensor pressure from the first model pressure and of the second sensor pressure from the second model pressure, a fault signal indicating a leak in the crankcase ventilation system is output by the diagnostic device.

In yet a further aspect of the inventive method, the method includes the steps of: measuring the first and second sensor pressures with the first pressure sensor and the second pressure sensor; comparing the first and second sensor pressures with a first and a second model pressure with the diagnostic device; evaluating whether a sensor pressure differs from the model pressure or not; and in the event of a difference of the first sensor pressure from the first model pressure and no difference of the second sensor pressure from the second model pressure, a fault signal indicating a leak in the tank ventilation system is output by the diagnostic device.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 4 shows the logic of a leak diagnosis in a table.

The same reference numbers apply for identical components in FIGS. 1 through 3 below.

DETAILED DESCRIPTION OF THE DRAWINGS

Figure 1:
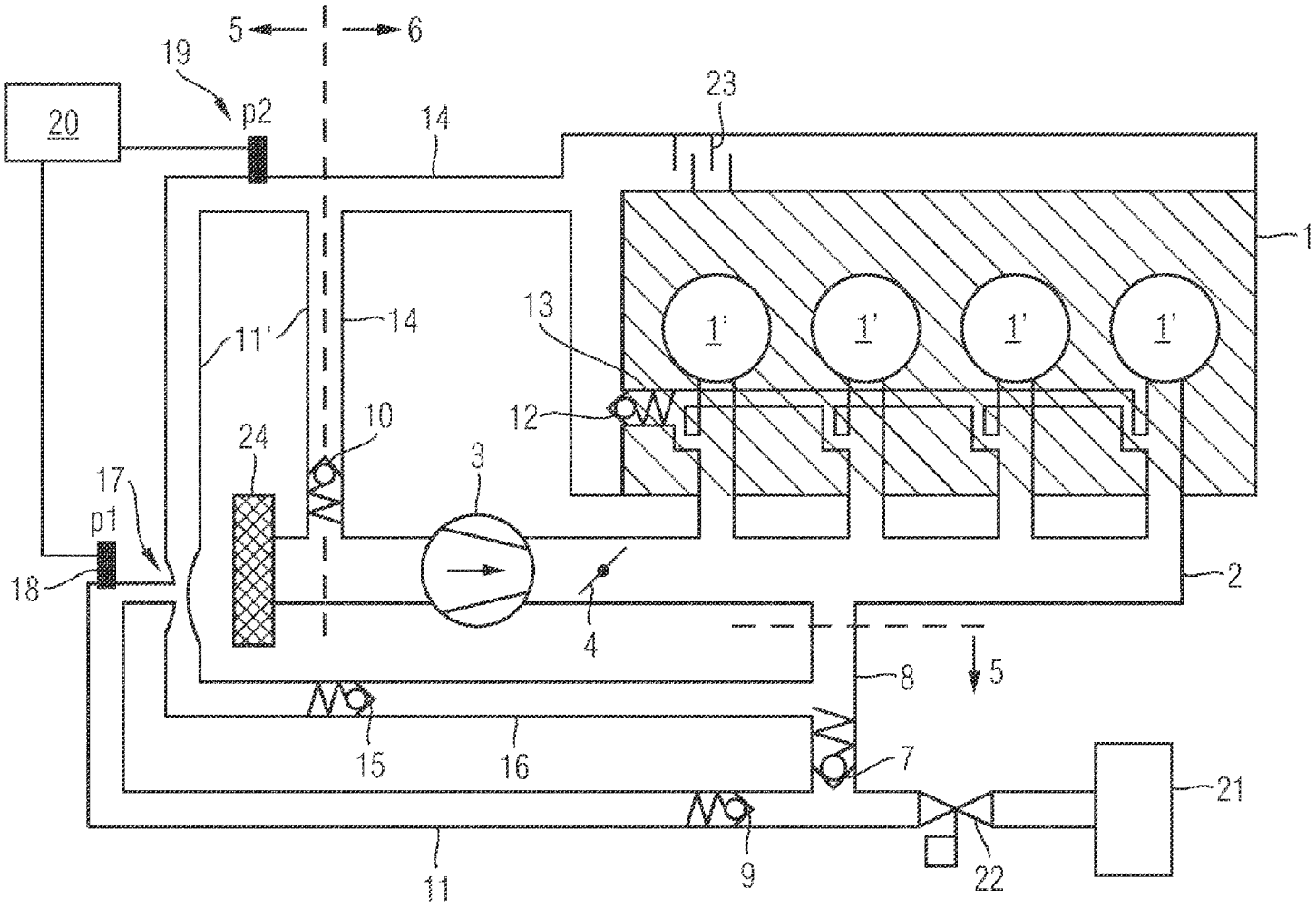
FIG. 1 shows an internal combustion engine according to an embodiment of the invention in a schematic representation.

FIG. 1 shows in a schematic representation an internal combustion engine 1 with, for example, four cylinders 1' indicated by circles, and with a combustion air induction system 2, in which a compressor 3, for example of an exhaust turbocharger or even a mechanical compressor. The cylinders are disposed in the direction of flow of combustion air (represented by an arrow in the compressor) downstream of a throttle element 4, such as for example a throttle flap. The internal combustion engine 1 further comprises a tank ventilation system 5 for a fuel tank 21, and a crankcase ventilation system 6. The spatial separation of the tank ventilation system 5 and of the crankcase ventilation system 6 is represented schematically by arrows.

The tank ventilation system 5 can be connected, via a first non-return valve 7 in a first line 8, to the induction system 2 downstream of the throttle element 4 in the direction of flow of the induction air. The tank ventilation system 5 can be further connected, via a second and a third non-return valve 9, 10 in a second line 11, to the induction system 2 upstream of the compressor 3. The crankcase ventilation system 6 can be connected, via a fourth non-return valve 12 in a third line 13, to the induction system 2 downstream of the throttle element 4, and via a fourth line 14 and the third non-return valve 10 to the induction system 2 upstream of the compressor 3. In the present exemplary embodiment, the second line 11 and the fourth line 14 share the common third non-return valve 10. In another exemplary embodiment, two separate lines can each be provided with a non-return valve for this purpose.

According to the invention, the induction system 2 can be connected downstream of the throttle element 4 via a fifth non-return valve 15 in a fifth line 16 to the second line 11 at a line transition between the second line 11 and the second sub line 11', wherein a nozzle 17, preferably a Laval nozzle, in which the second line 11 opens downstream of the second non-return valve 9, is implemented at the line transition from the fifth line 16 to the second line 11 and the second sub line 11'. A first pressure sensor 18 for measuring the pressure in the second line 11 is provided between the second non-return valve 9 and the nozzle 17 in the second line 11.

With this basic configuration of the internal combustion engine 1, according to the invention a method for detecting a leak in a crankcase ventilation system 6 and/or in the tank ventilation system 5 is represented with the following steps of the method.

Method 1

(1) Start the internal combustion engine 1;

(2) Measure a first sensor pressure with the first pressure sensor 18;

(3) Compare the first sensor pressure with a first model pressure with a diagnostic device 20;

(4) Evaluate whether the sensor pressure differs from the model pressure or not;

(5) If there is no difference of the sensor pressure from the model pressure, no fault output is produced by the diagnostic device 20; and (6) If there is a difference of the sensor pressure from the model pressure, a fault output is produced by the diagnostic device 20.

Thus, according to the invention a leak in the tank ventilation system 5 or in the crankcase ventilation system 6 can be detected in simple manner with a single pressure sensor, wherein the model pressure always represents a faultless system.

In a further stage of development, a second pressure sensor 19 for measuring the pressure in the second sub line 11' (or the fourth line 14) is provided downstream of the nozzle 17 in the second line 11 (or the fourth line 14). The evaluation of the pressure of the pressure sensors 18, 19 is again preferably carried out by the diagnostic device 20. With this further stage of development of the internal combustion engine 1 according to the invention, two further methods are now possible, which comprise the following method steps.

Method 2

(1) Measuring the first pressure and a second sensor pressure with the first pressure sensor 18 and the second pressure sensor 19;

(2) Comparing the first and second sensor pressures with first and second model pressures with the diagnostic device 20;

(3) Evaluating whether a sensor pressure differs from the model pressure or not;

(4) In the event of a difference of the first sensor pressure from the first model pressure and of the second sensor pressure from the second model pressure, a signal representing a leak in the crankcase ventilation system 6 is output by the diagnostic device 20.

Method 3

(1) Measuring the first and second sensor pressures with the first pressure sensor 18 and the second pressure sensor 19;

(2) Comparing the first and second sensor pressures with a first and a second model pressure with a diagnostic device 20;

(3) Evaluating whether a sensor pressure differs from the model pressure or not; and (4) In the event of a difference of the first sensor pressure from the first model pressure and no difference of the second sensor pressure from a second model pressure, a fault signal indicating a leak in the tank ventilation system 5 is output by the diagnostic device 20.

For the integrity of the internal combustion engine 1 according to the invention, it should also be noted that the induction air is cleaned by an air filter 24 before it enters the combustion air induction system 2. Furthermore, an oil separator 23 is provided in the crankcase ventilation system 6 in order to reliably prevent oil mist from flowing into the combustion air induction system 2.

In a further embodiment, a tank ventilation valve 22 is provided in the first line 8 between the tank 21 and the first and second non-return valves 7, 9 in order to control the tank ventilation as required.

In a further preferred embodiment, a second throttle element (not represented here) is provided between the fourth non-return valve 12 and the fourth line 14. Using said second throttle element, which can be a volumetric flow regulating valve or a pressure regulating valve, a desired crankcase pressure is set.

Figure 2:
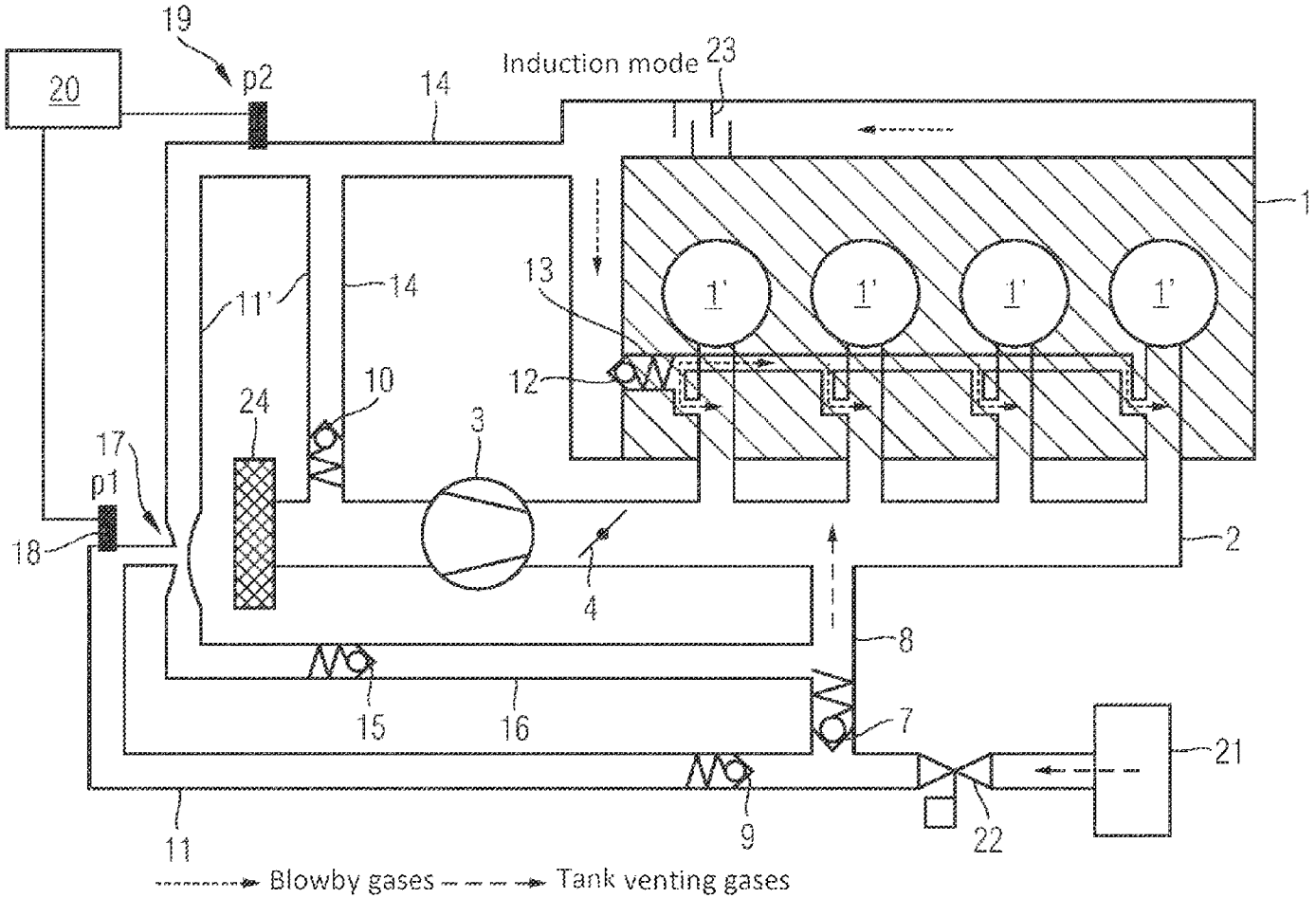
FIG. 2 shows the internal combustion engine in the induction mode in a schematic representation.

FIG. 2 shows once again the internal combustion engine according to the invention 1 from FIG. 1, with the pressure conditions and flow conditions in the induction mode, i.e. in the mode in which no charger pressure from the compressor has yet built up. The crankcase ventilation gases are represented in dotted form, the tank-ventilation gases are represented in dashed form. As shown in FIG. 2, the tank ventilation is carried out in the induction mode via the tank ventilation valve 22 and the non-return valve 7 in the combustion air induction system 2. The crankcase ventilation gases first flow through the oil separator 23 and are then fed via the fourth non-return valve 12 in the third line 13 into the combustion air induction system 2. Said flow conditions result in a vacuum prevailing in the combustion air induction system 2 downstream of the compressor 3, because the pistons (not shown here) in the cylinders 1' act as a vacuum pump.

Figure 3:
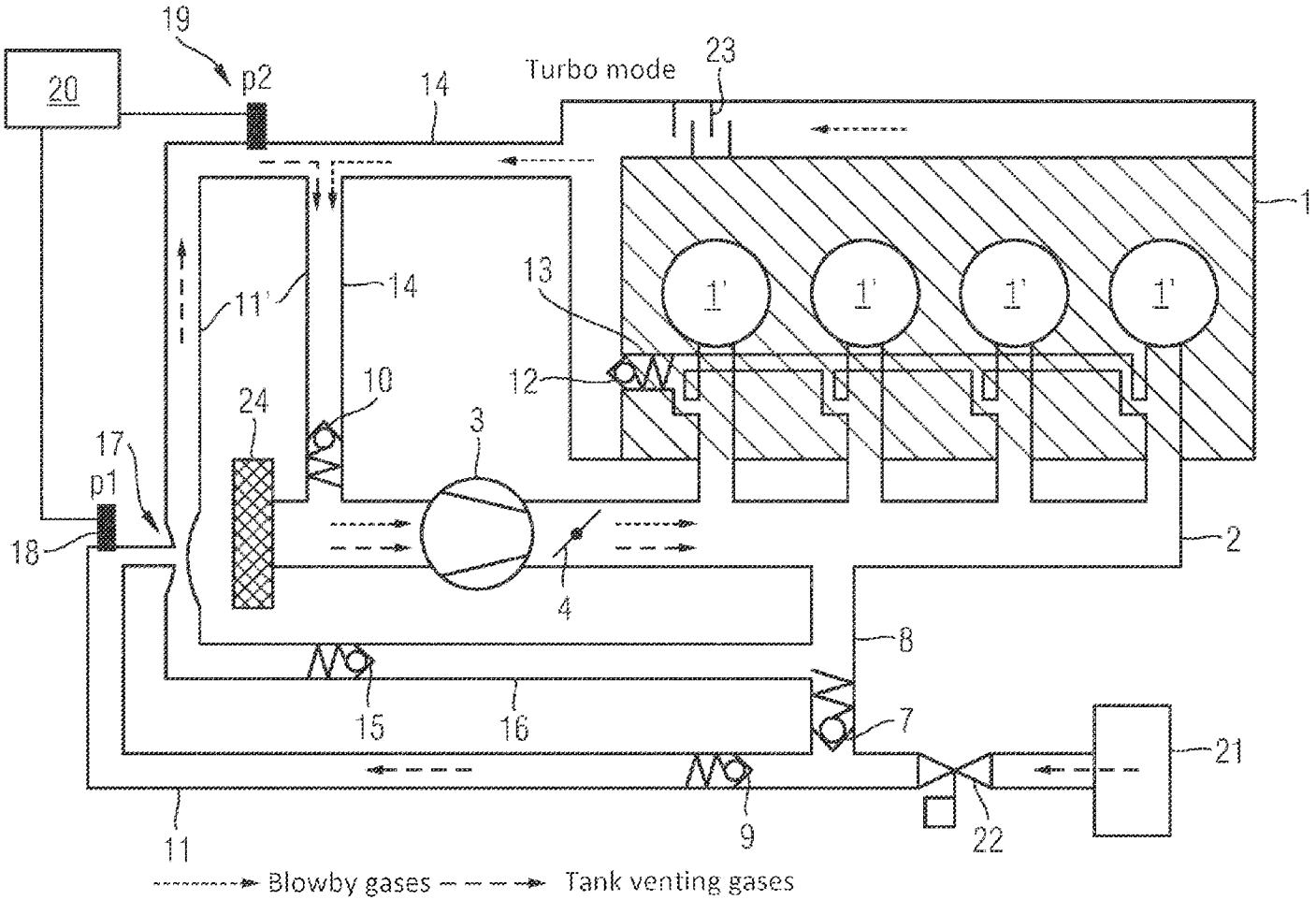
FIG. 3 shows the internal combustion engine in the turbo mode in a schematic representation.

By contrast, FIG. 3 shows the internal combustion engine 1 according to the invention in the turbo mode, i.e. when the compressor 3 is compressing the combustion air upstream of the cylinders 1'. In this case, an overpressure prevails in the combustion air induction system 2 downstream of the compressor 3, resulting in the tank ventilation gases passing via the tank ventilation valve 22 and the second non-return valve 9 towards the nozzle 17, and from there further via the third non-return valve 10 into the combustion air induction system 2 upstream of the compressor 3. On the other hand, in the turbo mode the crankcase ventilation gases are also fed via the oil separator 23 and the fourth line 14 and via the third non-return valve 10 into the combustion air induction system 2 upstream of the compressor 3. From there, they are transported together with the tank ventilation gases towards the cylinders 1'.

FIG. 4 shows in a table the logic of fault signal output by the diagnostic device 20. If a sensor pressure equals the model pressure, then the logic value is 1. If a sensor pressure is not equal to the model pressure, then the logic value is 0.

This results in a first system state with a sensor pressure p1=1 and a sensor pressure p2=1, i.e. there is no leak and no fault is output by the diagnostic device 20.

This results in a second system state with a sensor pressure p1=0 and a sensor pressure p2=0, in which there is a leak downstream of the suction jet pump, i.e. there is a fault output by the diagnostic device 20.

This results in a third system state with a sensor pressure p1=0 and a sensor pressure p2=1, in which there is a leak upstream of the suction jet pump (tank ventilation side), i.e. there is a fault output by the diagnostic device 20.

Once again, the detailed method for determining the system states.

Method 1

(1) Starting the internal combustion engine 1;

(2) Measuring a first sensor pressure with the first pressure sensor 18;

(3) Comparing the first sensor pressure with a first model pressure with a diagnostic device 20;

(4) Evaluating whether the sensor pressure differs from the model pressure or not;

(5) In the event of no difference of the sensor pressure from the model pressure, a fault signal is not output by the diagnostic device 20; and (6) In the event of a difference of the sensor pressure from the model pressure, a fault signal is output by the diagnostic device 20.

Method 2

(1) Measuring the first and second sensor pressures with the first pressure sensor 18 and the second pressure sensor 19;

(2) Comparing the first and second sensor pressures with a first and second model pressure with the diagnostic device 20;

(3) Evaluating whether a sensor pressure differs from the model pressure or not; and (4) In the event of a difference of the first sensor pressure from the first model pressure and of the second sensor pressure from the second model pressure, a signal representing a leak in the crankcase ventilation system 6 is output by the diagnostic device 20.

Method 3

(1) Measuring the first and second sensor pressures with the first pressure sensor 18 and the second pressure sensor 19;

(2) Comparing the first and second sensor pressures with a first and a second model pressure with a diagnostic device 20;

(3) Evaluating whether a sensor pressure differs from the model pressure or not; and (4) In the event of a difference of the first sensor pressure from the first model pressure and no difference of the second sensor pressure from the second model pressure, a fault output representing a leak in the tank ventilation system 5 is produced by the diagnostic device 20.

REFERENCE CHARACTER LIST

1. internal combustion engine
1' cylinder
2. combustion air induction system
3. compressor
4. throttle element
5. tank ventilation system
6. crankcase ventilation system
7. first non-return valve
8. first line
9. second non-return valve
10. third non-return valve
11. second line
11' second sub line
12. fourth non-return valve
13. third line
14. fourth line
15. fifth non-return valve
16. fifth line
17. nozzle
18. first pressure sensor
19. second pressure sensor
20. diagnostic device
21. tank
22. tank ventilation valve
23. oil separator
24. air filter The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine, comprising:

a combustion air induction system in which a compressor is arranged and in which a throttle element is arranged downstream of the compressor in a flow direction of the combustion air:

a tank ventilation system, wherein the tank ventilation system is connectable to the induction system downstream of the throttle element via a first non-return valve in a first line and upstream of the compressor via a second non-return valve in a second line and a third non-return valve in a second sub-line;

a crankcase ventilation system, wherein the crankcase ventilation system is connectable to the induction system downstream of the throttle element via a fourth non-return valve in a third line, and upstream of the compressor via a fourth line and the third non-return valve; wherein the induction system is connectable downstream of the throttle element via a fifth non-return valve in a fifth line to the second line at a transition point between the second line and the second sub line;

a nozzle is formed at the transition point from the fifth line to the second line and the second sub line, wherein the second line opens into the nozzle downstream of the second non-return valve; and a first pressure sensor measures pressure in the second line, the first pressure sensor being provided in the second line between the second non-return valve and the nozzle.

2. The internal combustion engine according to claim 1, further comprising:

a second pressure sensor provided in the second sub line or in the fourth line.

3. The internal combustion engine according to claim 2, further comprising:

a diagnostic device that evaluates pressures sensed by the first and second pressure sensors.

4. The internal combustion engine according to claim 1, further comprising:

a tank ventilation valve provided in the first line between a tank and the first and second non-return valves.

5. The internal combustion engine according to claim 2, further comprising:

a tank ventilation valve provided in the first line between a tank and the first and second non-return valves.

6. The internal combustion engine as claimed in claim 1, further comprising:

a second throttle element provided between the fourth non-return valve and the fourth line.

7. The internal combustion engine as claimed in claim 5, further comprising:

a second throttle element provided between the fourth non-return valve and the fourth line.

8. The internal combustion engine according to claim 1, further comprising:

a diagnostic device that evaluates pressure sensed by the first pressure sensor.

9. A method for detecting a leak from a crankcase ventilation system and/or a tank ventilation system of an internal combustion engine, wherein the internal combustion engine comprises a combustion air induction system in which a compressor is arranged and in which a throttle element is arranged downstream of the compressor in a flow direction of the combustion air;

the tank ventilation system is connectable to the induction system downstream of the throttle element via a first non-return valve in a first line and upstream of the compressor via a second non-return valve in a second line and a third non-return valve in a second sub-line;

the crankcase ventilation system is connectable to the induction system downstream of the throttle element via a fourth non-return valve in a third line, and upstream of the compressor via a fourth line and the third non-return valve;

the induction system is connectable downstream of the throttle element via a fifth non-return valve in a fifth line to the second line at a transition point between the second line and the second sub line;

a nozzle is formed at the transition point from the fifth line to the second line and the second sub line, wherein the second line opens into the nozzle downstream of the second non-return valve;

a first pressure sensor measures pressure in the second line, the first pressure sensor being provided in the second line between the second non-return valve and the nozzle, the method comprising the steps of:

starting the internal combustion engine;

measuring a first sensor pressure with the first pressure sensor;

comparing, via a diagnostic device, the first sensor pressure with a first model pressure;

evaluating whether the first sensor pressure differs from the first model pressure or not;

in an event of no difference of the first sensor pressure from the first model pressure, no fault signal is output by the diagnostic device; and in an event of a difference of the first sensor pressure from the first model pressure, a fault signal is output by the diagnostic device.

10. A method for detecting a leak from a crankcase ventilation system and/or a tank ventilation system of an internal combustion engine, wherein the internal combustion engine comprises a combustion air induction system in which a compressor is arranged and in which a throttle element is arranged downstream of the compressor in a flow direction of the combustion air;

the tank ventilation system is connectable to the induction system downstream of the throttle element via a first non-return valve in a first line and upstream of the compressor via a second non-return valve in a second line and a third non-return valve in a second sub-line;

the crankcase ventilation system is connectable to the induction system downstream of the throttle element via a fourth non-return valve in a third line, and upstream of the compressor via a fourth line and the third non-return valve;

the induction system is connectable downstream of the throttle element via a fifth non-return valve in a fifth line to the second line at a transition point between the second line and the second sub line;

a nozzle is formed at the transition point from the fifth line to the second line and the second sub line, wherein the second line opens into the nozzle downstream of the second non-return valve;

a first pressure sensor measures pressure in the second line, the first pressure sensor being provided in the second line between the second non-return valve and the nozzle;

a second pressure sensor is provided in the second sub line or the fourth line, the method comprising the steps of:

measuring the first and second sensor pressures with the first pressure sensor and the second pressure sensor;

comparing, via a diagnostic device, the first and second sensor pressures with a first and a second model pressure;

evaluating whether the first and second sensor pressures differ from the first and second model pressures or not; and in an event of a difference of the first sensor pressure from the first model pressure, and of the second sensor pressure from the second model pressure, outputting via the diagnostic device a fault signal indicating a leak in the crankcase ventilation system.

11. The method according to claim 10, further comprising the step of:

in an event of a difference of the first sensor pressure from the first model pressure and no difference of the second sensor pressure from the second model pressure, outputting by the diagnostic device a fault signal indicating a leak in the tank ventilation system.

* * * * *